United States Patent [19]

Burton

[11] Patent Number: 4,739,843

[45] Date of Patent: Apr. 26, 1988

[54] APPARATUS FOR LATERAL DRILLING IN OIL AND GAS WELLS

[75] Inventor: Michael B. Burton, Tulsa, Okla.

[73] Assignee: Sidewinder Tool Joint Venture, Tulsa, Okla.

[21] Appl. No.: 69,421

[22] Filed: Jul. 2, 1987

Related U.S. Application Data

[63] Continuation-in-part of Ser. No. 862,246, May 12, 1986, Pat. No. 4,699,224.

[51] Int. Cl.[4] ..... E21B 7/08; E21B 7/10

[52] U.S. Cl. ..... 175/73; 175/61; 175/325

[58] Field of Search ..... 175/325, 73, 74, 82, 175/83, 61, 62

[56] References Cited

U.S. PATENT DOCUMENTS

| | | | |
|---|---|---|---|
| 2,687,282 | 8/1954 | Sanders | 175/61 X |
| 3,457,999 | 7/1969 | Massey | 175/61 |
| 4,040,495 | 8/1977 | Kellner et al. | 175/61 X |
| 4,220,213 | 9/1980 | Hamilton | 175/45 |
| 4,416,339 | 11/1983 | Baker et al. | 175/61 |
| 4,428,441 | 1/1984 | Dellinger | 175/61 |
| 4,449,595 | 5/1984 | Holbert | 175/325 X |
| 4,456,080 | 6/1984 | Holbert | 175/61 |
| 4,465,147 | 8/1984 | Feenstra et al. | 175/325 X |
| 4,560,013 | 12/1985 | Beimgraben | 175/325 X |

*Primary Examiner*—Stephen J. Novosad
*Attorney, Agent, or Firm*—Head & Johnson

[57] ABSTRACT

A method and associated apparatus for lateral drilling in an oil and/or gas well involving either stopping the drilling or temporarily cementing in a plug in the existing well bore at the desired location for deviation. A tight radius of curvature is then rotary drilled by use of a flexible drilling collar made up of a series of short drill string sections interconnected by universal joints that terminate within an eccentric collar on the final drill string section. The eccentric collar is equipped with a sidewall engaging means to hold the eccentric collar from rotating during rotary drilling. A flexible collar (e.g., ball and socket) extending outwardly and downwardly from the far end of the final drill string section passing through the eccentric collar connects to a drill bit collar and rotary drill bit. A stabilizer/reamer of essentially the same size or slightly larger diameter than the drill bit surrounds the drill bit collar, thus producing a fulcrum for tilting the drill bit perpendicular to the well bore. The eccentric collar on the last drill string section that engages the well bore forces the deflection of the drill bit about the fulcrum and holds this orientation as the rotating drill proceeds forward. Such a technique can achieve a twelve foot radius of curvature in an existing oil or gas well bore for establishing lateral drain holes essentially horizontal to the otherwise vertical well bore.

12 Claims, 10 Drawing Sheets

APPARATUS FOR LATERAL DRILLING IN OIL AND GAS WELLS

CROSS REFERENCE TO RELATED APPLICATIONS

This application is a continuation-in-part application of my currently pending application Ser. No. 862,246, entitled "METHOD AND APPARATUS FOR LATERAL DRILLING IN OIL AND GAS WELLS", filed May 12, 1986, now U.S. Pat. No. 4,699,224.

BACKGROUND OF THE INVENTION

1. Field of the Invention:

This invention relates to a method and apparatus for horizontal drilling. More specifically, but not by way of limitation, this invention relates to lateral drilling in oil and gas wells, coal degassification wells, geothermal wells and the like.

2. Description of the Prior Art:

It is generally known that the final portion of a rotary drilling string (the so-called drilling collar) or the like is under compressive loads and torque during drilling, while the upper portion of the drilling string is under tension. As such, the weight of the drill collar below the point of last contact with the borehole wall may be thought of as being divided into two components; one acting along the axis of the collars and the second acting normal to the first, i.e. perpendicular to the borehole.

It is also generally known that, in principle, if the downhole orientation and magnitude of the normal force could be controlled during drilling, the drill bit could essentially be steered to any desired subsurface location or strata. Although theoretically possible and highly desirable, such a process and corresponding drilling equipment to achieve such a goal have not yet been developed. However, various processes and associated equipment have been employed that generally achieve varying degrees of what is recognized in the art as directional drilling. For example, it is common practice in oil and gas well drilling to use a so-called "whipstock" (a sloped plug inserted below the drill bit) to intentionally deflect the drill bit in a desired direction, thus creating a deviation in the direction of drilling.

It is also a common practice in oil and gas well drilling to employ equipment and method for minimizing or eliminating the effect of the force normal to the borehole, such as to maintain the drilling in a vertical line. Thus, various types of drilling collars, stabilizers and the like have been proposed to keep the drilling process proceeding uniformly in one direction. For example, U.S. Pat. Nos. 3,145,785 and 4,319,649 disclose drill collar stabilizers to maintain the drilling in a straight line.

In U.S. Pat. No. 4,220,213 an eccentric member having a heavy, thick walled side and a lighter, thin walled side is placed concentrically about the drill bit collar of a rigid drill string with an offset protection on the outside of the eccentric member positioned usually 90 degrees to the right of the heavy, thick walled portion. In this manner, gravity will cause the heavy, thick walled portion of the eccentric collar to rotate to the underside or low side of a deviating drill string, thus positioning the projection such as to alleviate or compensate for the undesirable "walking" of the drill bit. In other words, an eccentric tubular member rotatably supported on the drill string is used to prevent the drill bit from moving laterally and the resulting normal force continuously restores the hole to vertical.

Various types of drilling collar stabilizers have also been proposed to alter the direction of drilling. For example, U.S. Pat. Nos. 4,305,474 and 4,465,147 disclose stabilizers that create a deflecting force perpendicular to the drill string in order to control and guide the drill bit along a desired course of direction. Also, the use of an eccentric stabilizer has been proposed in U.S. Pat. No. 4,076,084 to drill a directionally oriented hole such as commonly practiced when drilling from an offshore platform or the like.

One particularly difficult type of drilling process to control is the so-called lateral drilling or horizontal drilling. Unlike the concept of directional drilling wherein radii in terms of thousands of feet and deviations up to one to two miles are to be achieved relative to the surface location of the drilling platform or drilling rig, the concept of lateral drilling involves creating a highly curved well bore usually as an offshoot from a pre-drilled well bore. Thus, for example, in U.S. Pat. No. 4,402,551 a whipstock is employed to drill short radius horizontal holes below a vertical cased well bore. It is acknowledged in this patent that current state-of-the-art techniques limit the smallest radius of curvature for surface drilling to 19 feet (i.e., 3 degrees of deflection per foot over 30 feet of linear drilling) to produce a horizontal drainhole at depths greater than 2,000 feet. It is this particular type of highly curved or tight radius drilling of oil and gas wells and the like that the present invention addresses.

In prior attempts to use rotary drilling techniques to achieve a tight radius of curvature (see for example, U.S. Pat. No. 2,687,282) a section of flexible drilling string made up of short segments interconnected by universal joints which in turn terminate in a ball and socket connection to a drill bit collar with stabilizer and rotary drill bit were employed. Although such apparatus could drill a well bore with a tight radius of curvature, the method and apparatus were unacceptable in that the radius of curvature would experience a significant deviation out of the plane of rotation. This in turn would result in a spiral or helical contribution to the curved part of the well bore resulting in an inability to achieve control of either the inclination or horizontal direction of the drainhole or lateral drilled offshoot. The present invention is viewed as being an improvement over the prior art methods and apparatus in that controlled curved drilling is achieved.

SUMMARY OF THE INVENTION

In view of the problems associated with the prior art methods and apparatus for lateral drainhole drilling and particularly the tendency for prior art processes to spiral off center during the drilling of the curved portion of the drainhole, the present invention provides an improved lateral drilling technique that employs rotary drilling using a flexible drill string connected by a flexible joint (preferably a ball and socket joint) to a drill bit collar equipped with a stabilizer and rotary drilling bit. The present invention employs at least one novel eccentric member with sidewall engaging means that attaches or circumferentially mounts to the downhole end of the flexible drilling string directly over the flexible joint leading to the drill bit collar. The presence of the eccentric member or collar forces the drill bit string passing therethrough to one side of the well bore, thus lever arming the drill bit to the other side of the well bore by virtue of pivoting on the stabilizer/reamer mounted to the drilling bit collar between the flexible joint and drill bit. The presence of the sidewall engaging means prevent the eccentric collar from rotating in the well bore, thus resulting in a tightly curved well bore of short radius of curvature with essentially no change in inclination; i.e., no spiral effect.

Thus, the present invention provides a drilling apparatus for lateral drilling comprising:

(a) a flexible drilling string consisting of a series of short drill stem sections wherein each successive section is operatively interconnected to the next section by a flexible joint means;

(b) an eccentric, cylindrical collar means having a cylindrical hole passing therethrough wherein the central axis of the cylindrical hole is colinear with and displaced radially to one side relative to the central axis of the eccentric, cylindrical collar means and wherein the outer surface of the eccentric, cylindrical collar means opposite the side towards which the cylindrical hole is displaced is further equipped with a radially extending borehole engaging means that operatively engages the borehole during rotary drilling, thus preventing the eccentric, cylindrical collar means from rotating during rotary drilling and wherein the eccentric, cylindrical collar means operatively surrounds a portion of a drill stem section at the lower end of the flexible drilling string, thus allowing the flexible drilling string and drill stem section to revolve in the cylindrical hole during rotary drilling;

(c) a flexible joint connected to a drill bit collar and to the far end of the last drill stem section of the flexible drill string beneath the eccentric collar and adapted to flex arbitrarily in any direction during rotary drilling; and (d) a drill bit collar with rotary drill bit operatively attached to the flexible joint.

In one particular preferred embodiment of the invention, the flexible joint is a ball and socket and the radially extending borehole engaging means is a plurality of spring steel fin members longitudinally attached to the outer surface of the eccentric, cylindrical collar means such that the spring steel fin members are essentially parallel to each other and radially sloped to oppose the rotation of the eccentric cylindrical collar means during rotary drilling.

In still another particularly preferred embodiment of the invention, an eccentric, cylindrical sleeve means is provided displacing a short distance from and rigidly attached to the eccentric, cylindrical collar means. The eccentric, cylindrical sleeve means is essentially identical in size and shape to the eccentric, cylindrical collar means including the radially displaced cylindrical hole and radially extending borehole engaging means on the side opposite to the direction of displacement of the hole.

In another preferred embodiment of the invention, the eccentric cylindrical collar means is provided with a unidirectional clutch mechanism (e.g., a ratchet means) which allows the drill string to turn freely inside it when drilling but locks the collar means to the drill string when rotated in the opposite direction. This ratchet mechanism allows the operator to initially orient and/or later re-orient the collar means and the direction the drilled hole is curving. Port means are provided from the interior of the drill string to the space between the eccentric collar means and the drill string so that drilling fluid may lubricate that space. Further, a deflector ring is provided on the drill pipe section at the top of the cylindrical collar means to aid in preventing cuttings from going into the annular space between the cylindrical collar means and the drill pipe.

It is an object of the present invention to provide a method of consistently and reliably drilling lateral, horizontal drainholes in oil and gas wells and the like. It is a further object that the lateral drilling be characterized by relatively short radii of curvature as well as the absence of significant angular or axial deviation (spiral rotation) of the curved portion of the laterally drilled drainhole. It is another object of the present invention to provide a ratchet mechanism that will allow for initial orientation as well as re-orientation of the direction of curved drilling as desired. Fulfillment of these objects and the presence and fulfillment of additional objects will become apparent upon complete reading of the attached specification and claims taken in view of the accompanying drawings.

DESCRIPTION OF THE PREFERRED EMBODIMENT

As previously indicated, the concept of lateral drainhole drilling can be distinguished from the concept of directional drilling in terms of the degree of curvature or more specifically, the rate of change of curvature. Typically, directional drilling will involve low rates of deviation from vertical such as 0.05 degree per foot which corresponds to large radii of curvature, e.g. 2,000 to 3,000 feet. Also, the angle of deviation of "drift angle" in directional drilling seldom exceeds 65 to 70 degrees. In contrast, lateral drainhole drilling is characterized by a rate of change of angle of the order of 3 to 5 degrees per foot resulting in radii of curvature of 20 to 10 feet and a final drift angle of usually 90 degrees. In lateral drainhole drilling, the drilling of the curved portion of the drainhole is followed by drilling horizontally, sometimes for as much as several hundred feet. Generally, drainholes can be drilled as part of the completion of a new well or as a recompletion or work over technique to stimulate the production of existing wells.

The improved method and apparatus for drilling a lateral curved borehole (drainholes) according to the present invention, how these improvements relate to, differ from and are incorporated into previous methods and the improvements, advantages and differences relative to what has previously been employed in the oil and gas well drilling industry, can perhaps be best explained and understood by reference to the accompanying drawing.

Figure 1:
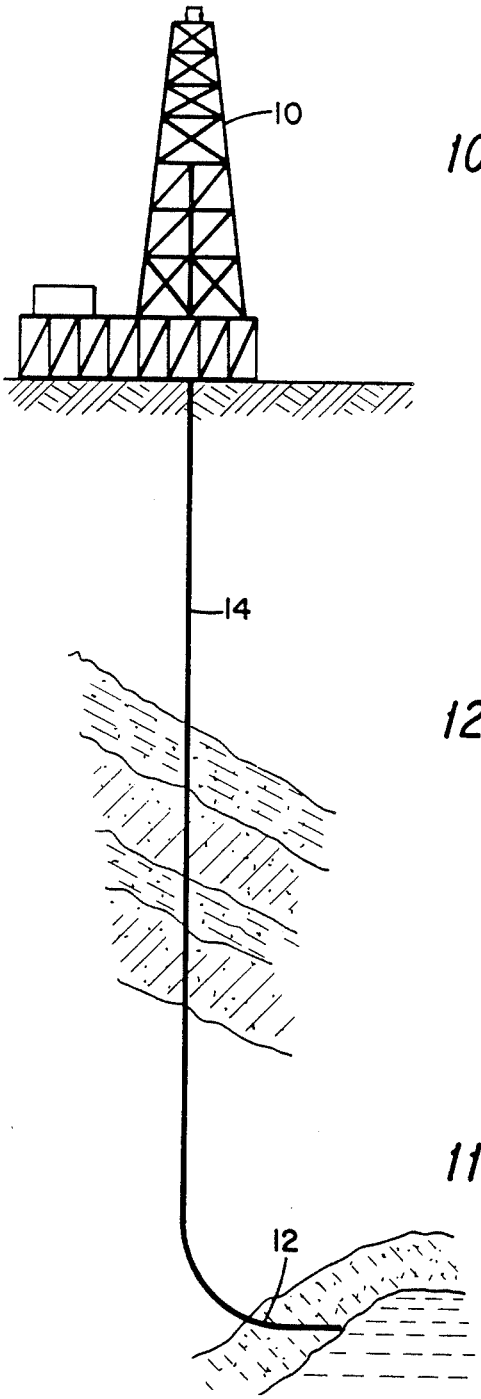
FIG. 1 is a cut-away view schematically illustrating the concept of lateral drainhole drilling according to the present invention.
Figure 9:
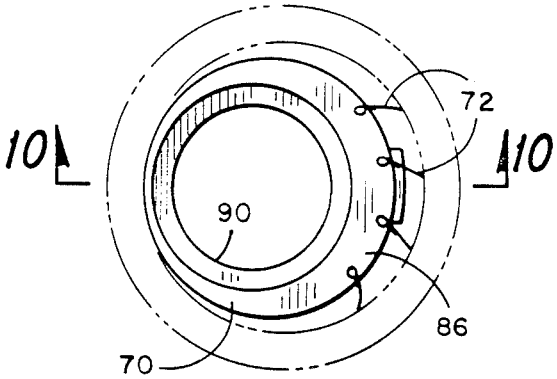
FIG. 9 is a cross-sectional view of a well bore with the eccentric drill string collar and sleeve of FIG. 7 in contact with the sidewalls of a well bore (dashed lines).
Figure 2:
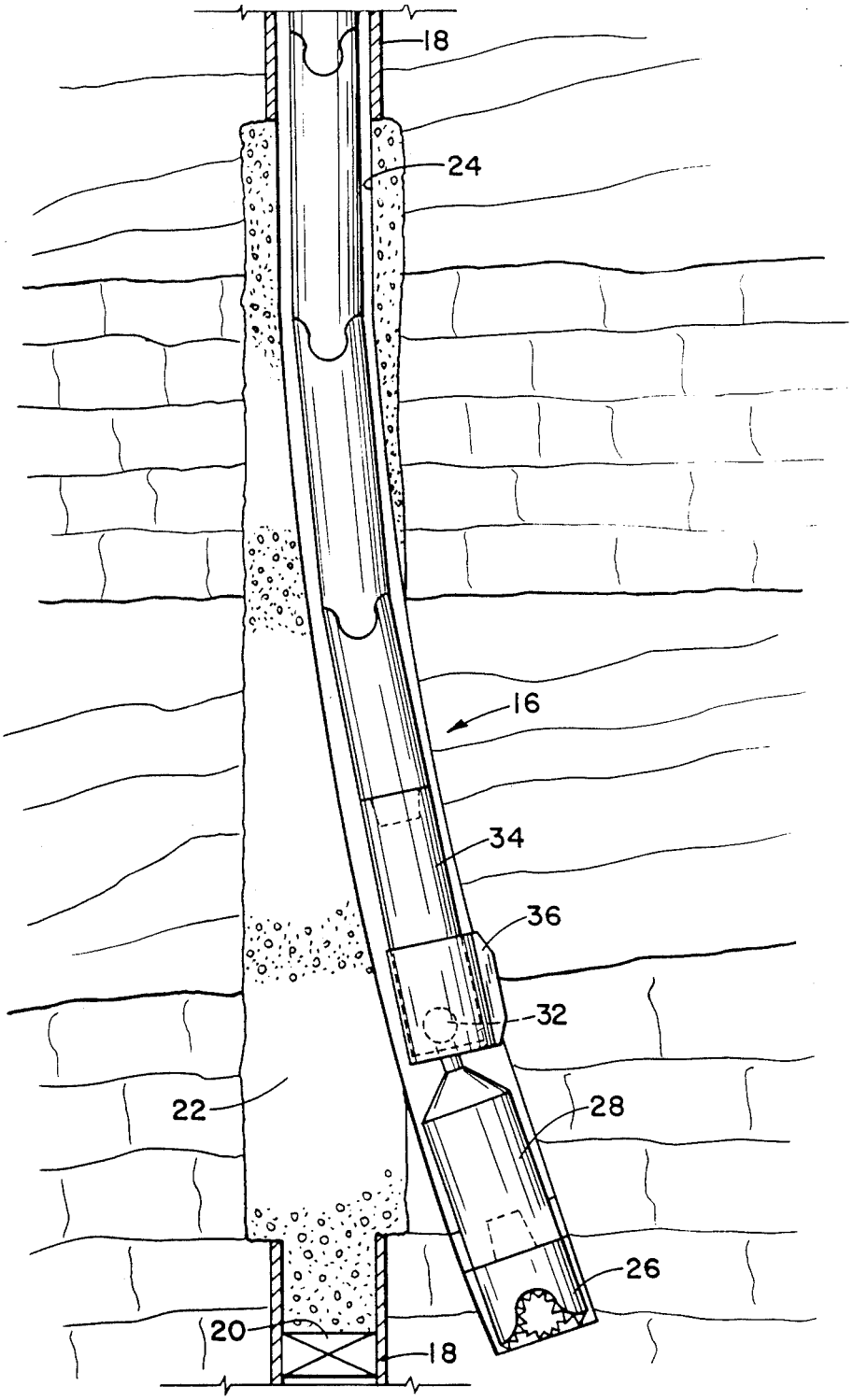
FIG. 2 illustrates a close-up view of the process and one specific embodiment of the equipment for lateral drilling shown in FIG. 1.

FIG. 1 schematically illustrates a typical rotary drilling rig 10 being employed to create a lateral drilling hole 12 essentially horizontal to the original vertical borehole 14. FIG. 2 is a close-up cross-sectional view of the various strata and one specific embodiment of a flexible drilling apparatus 16 as it deviates from the original well bore and begins to build angle. As illustrated in the specific embodiment of FIG. 2, the drilling apparatus 16 is being employed to drill a horizontal drainhole as a work over procedure in an existing cased well 18. It should be appreciated that the present invention is not limited to work over procedures of existing wells but can also be used in conjunction generally at any time during the drilling of a well or the like. As further shown in FIG. 2, the well bore is first plugged, generally at or near the top of the producing zone, by the use of a packer or simple bridge plug 20. The casing above the bridge plug 20 is then removed for typically twenty feet or more using a sectioning tool or other appropriate method as generally known in the art. Typically the tool will ream out the well bore by one to two inches beyond the outside diameter of the casing. The resulting cavity is then filled with cement 22 which is allowed to harden. The top of the cement plug 22 is then drilled vertically for a distance (typically two feet or more if necessary) sufficient to position the angle building assembly at the proper elevation relative to the desired end elevation for the particular radius of curvature to be drilled.

The rotary drill bit 26, drill bit collar 28 with stabilizer 30 (reamer), ball and socket 32 and end segment of the flexible drilling string 34 of the angle building assembly 16 are then inserted into the pilot hole 24 in such a manner that the eccentric collar 36 holds the ball joint 32 at the far end of the flexible drilling string 34 to the outer side of the pilot hole corresponding to the outer radius of the desired drainhole curvature. Consequently, the drill bit 26 is levered to the other side of the pilot hole 24 using the stabilizer or reamer 30 as a fulcrum.

With the angle building assembly positioned at the proper depth and correctly oriented, drilling can begin. As illustrated later, the angle building assembly and specifically the eccentric, cylindrical collar means 36 can be initially oriented as well as re-oriented at any time by simply rotating the drill string in a direction opposite to the rotary drilling in order to engage the clutch (see FIGS. 8 and 13) and then turning the drill string and entire angle building assembly to the desired proper orientation. In this manner the process according to the present invention can be used to assure that the hole is being drilled in the intended direction as well as to make desired deviations from the plane of curvature such as dog legs or the like.

Figure 4:
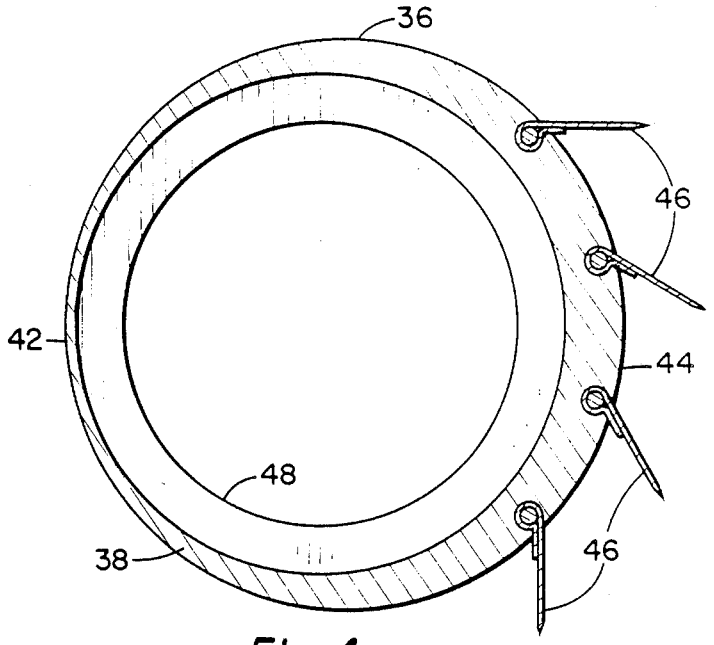
FIG. 4 is a cross-sectional view of the eccentric drill string collar of FIG. 3 as seen through line 4—4.
Figure 3:
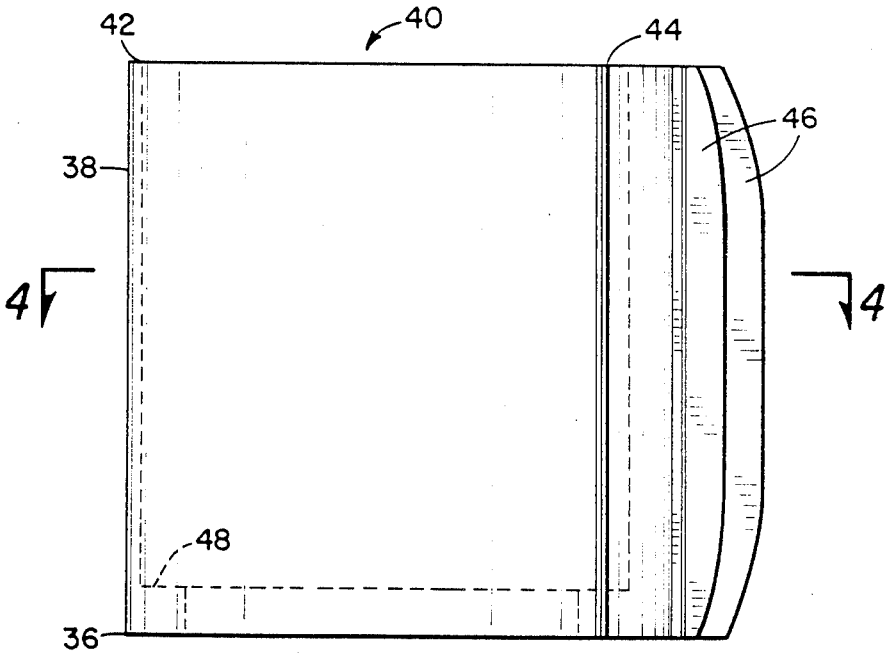
FIG. 3 is a side view of the eccentric drill string collar employed in the specific embodiment illustrated in FIG. 2.
Figure 5:
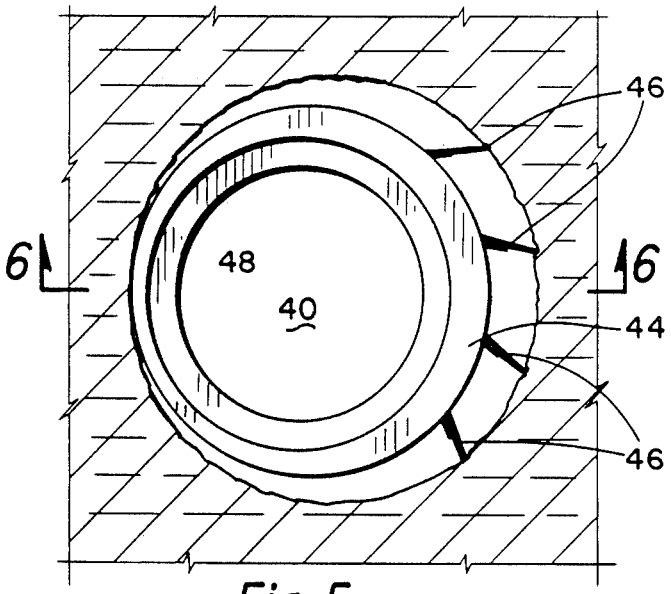
FIG. 5 is a cross-sectional view of a well bore with the eccentric drill string collar of FIG. 2 in contact with the sidewalls of the well bore.
Figure 6:
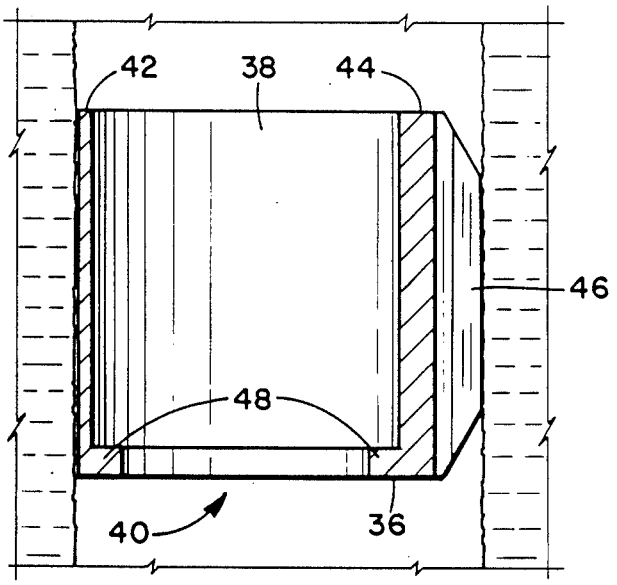
FIG. 6 is a cross-sectional view of the eccentric spring collar in the well bore of FIG. 5 as seen through line 6—6.

As seen in FIGS. 3 and 4, the collar 36 is a cylindrical steel sleeve 38 with a cylindrical hole 40 passing longitudinally therethrough wherein the axis of the hole 40, shown as a dashed line in FIG. 6, is intentionally displaced to one side of the central axis, shown as a dotted line in FIG. 6, of the cylindrical collar. The resulting offset creates a relatively thin region 42 on one side (see FIG. 4) and a relatively thick region 44 on the other side of the hole 40. As further illustrated, the thick region 44 has a plurality of spring steel fins 46 extending radially outward from the outer surface of the collar 36. These fins which are oversized to the hole are intentionally sloped in the direction of rotation such as to preload and thus resist the rotational motion of the flexible drill string revolving within the collar during rotary drilling. As further shown in FIGS. 5 and 6, the spring steel fins 46 engage the well bore and thus force the flexible drill string and the ball and socket knuckle 32 (not shown) to the far side of the well bore. Since the hole 40 is offset to this side, the lever action associated with the displacement is maximized. FIGS. 3 through 6 further show that the bottom side of the inner hole 40 of collar 36 is equipped with a circular ledge 48 that rests against the lower, outer edge of the last flexible section of the flexible drill string 34 (see FIG. 2), thus providing a thrust surface for advancing the collar with the drilling apparatus. Preferably the front face of the drill string inserted into the collar 36 and resting or approaching ledge 48 is rounded or beveled as explained later.

During use and as illustrated in FIGS. 2, 5 and 6, the spring steel fins 46 are sized and tapered at each end such that they cut into the well bore sidewalls; thus, the expression "well bore engaging means" is used in describing this feature of the invention. These fins 46 not only force the flexible joint between the drill string and drill bit to the opposite side of the well bore, and force the bit into the well bore formation, but also prevent the collar from rotating. The fins or more generally, the well bore engaging means, is further adapted to slide forward during rotary drilling while functionally preserving the relative axial orientation of the collar 36 in the well bore. This is felt to be critical in that it distinguishes the subject matter of the present invention from what was previously practiced in the lateral drilling art. By maintaining the orientation of the collar, the lever arm action about the drill bit collar stabilizer or reamer 30 as the fulcrum forces the advancing drill bit 26 to maintain a true heading or more specifically, a true curvature in a single plane of rotation colinear to the axial direction of advancement. In other words, no tendency for spiral or helical motion is present and no so-called "barber pole" rotation of the curved section of the drainhole takes place. Again, it is this particular attribute of the method of the present invention that serves to distinguish the process from the previous lateral drilling techniques. However, it should be appreciated that deviations from a simple plane can also be achieved by re-orienting the eccentric collar as previously described.

For purposes of this invention, the phrase "well bore engaging means" refers to any structure located on the outside of the eccentric, cylindrical collar opposite to the side to which the central hole is displaced (i.e., on the thicker portion of the eccentric collar) and functionally displaced the knuckle and the offset hole through which the drill string passes to the far side of the well bore during rotary drilling and holds this configuration throughout the drilling of the curve. In this manner, the displacement creates a lever action about the drill bit stabilizer as the fulcrum that in turn forces the drill bit back to the side of the well bore in contact with the well bore engaging means. Thus, the lever action causes the drill bit to continuously follow an essentially circular curved pathway. In the broadest sense, the phrase "well bore engaging means" encompasses any structure equivalent to the above that forces the drill bit string to the outside of the curved well bore and the drill bit to the inside of the curved well bore being rotary drilled and then holds each in this respective position throughout the drilling of the curved portion of the well bore.

Figure 7:
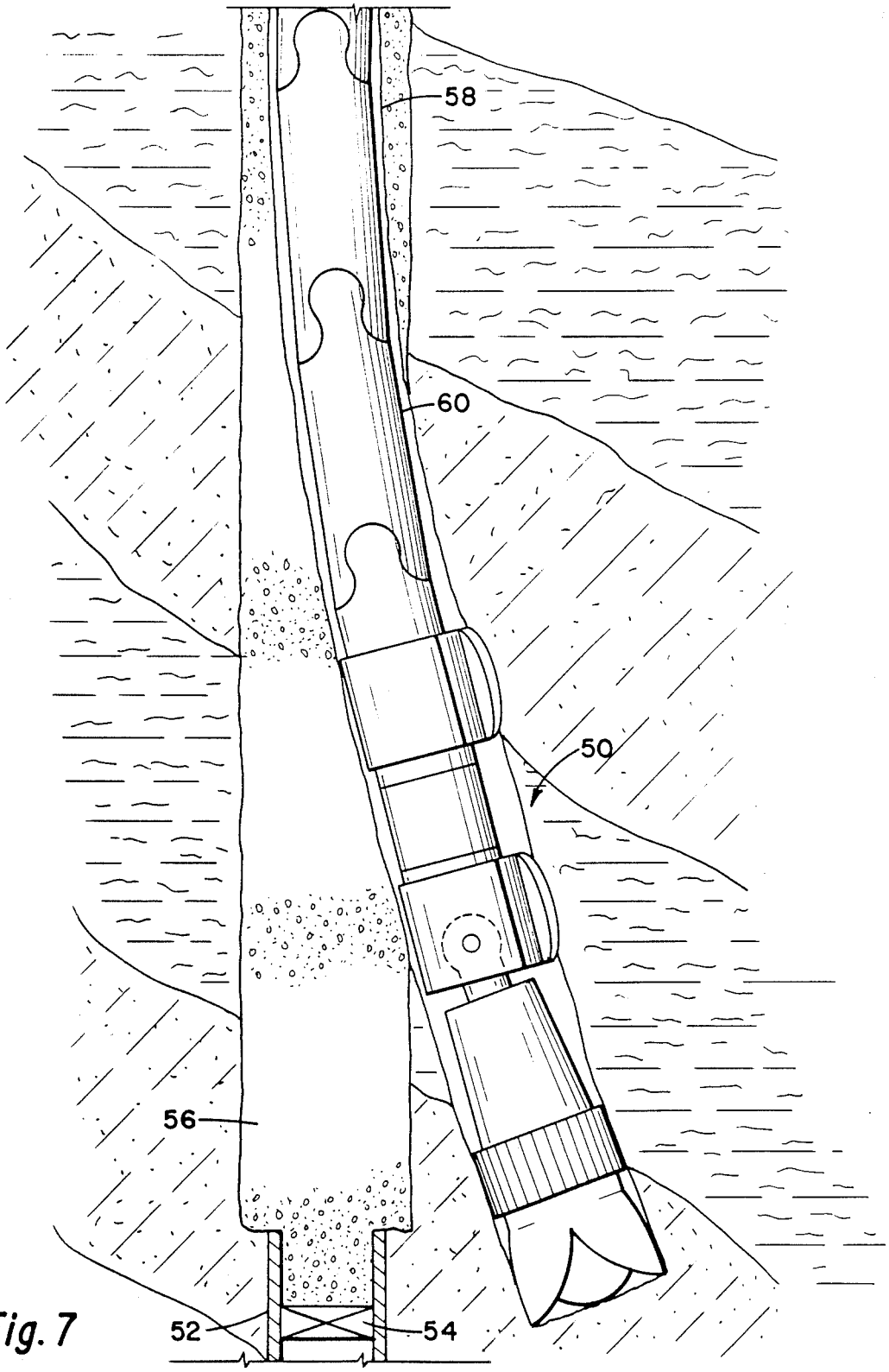
FIG. 7 illustrates a close-up view of the process and another specific embodiment of the equipment for lateral drilling shown in FIG. 1.

FIG. 7 illustrates a close-up cross-sectional view of another specific embodiment of a flexible drilling apparatus 50 as it begins to deviate through various strata from a starting original well bore 52. In a manner analogous to the previous embodiment of FIG. 2, the cased well bore 52 was first plugged with packer 54 and the casing above the plug 54 was removed. The resulting cavity was then filled with cement 56 which was allowed to harden before drilling a vertical pilot hole 58. The flexible drilling apparatus 50 attached to the flexible drill string 60 upon placement within pilot hole 58 and commencement of rotary drilling immediately begins the radially extending borehole engaging means is a plurality of spring steel fin members longitudinally attached to the outer surface of the eccentric, cylindrical collar means such that the spring steel fin members are essentially parallel to each other and radially sloped to oppose the rotation of the eccentric cylindrical collar means during rotary drilling.

In still another particularly preferred embodiment of the invention, an eccentric, cylindrical sleeve means is provided displacing a short distance from and rigidly attached to the eccentric, cylindrical collar means. The eccentric, cylindrical sleeve means is essentially identical in size and shape to the eccentric, cylindrical collar means including the radially displaced cylindrical hole and radially extending borehole engaging means on the side opposite to the direction of displacement of the hole.

In another preferred embodiment of the invention, the eccentric cylindrical collar means is provided with a unidirectional clutch mechanism (e.g., a ratchet means) which allows the drill string to turn freely inside it when drilling but locks the collar means to the drill string when rotated in the opposite direction. This ratchet mechanism allows the operator to initially orient and/or later re-orient the collar means and the direction the drilled hole is curving. Port means are provided from the interior of the drill string to the space between the eccentric collar means and the drill string so that drilling fluid may lubricate that space. Further, a deflector ring is provided on the drill pipe section at the top of the cylindrical collar means to aid in preventing cuttings from going into the annular space between the cylindrical collar means and the drill pipe.

It is an object of the present invention to provide a method of consistently and reliably drilling lateral, horizontal drainholes in oil and gas wells and the like. The presence of the sidewall engaging means prevent the eccentric collar from rotating in the well bore, thus resulting in a tightly curved well bore of short radius of curvature with essentially no change in inclination; i.e., no spiral effect.

Thus, the present invention provides a drilling apparatus for lateral drilling comprising:

(a) a flexible drilling string consisting of a series of short drill stem sections wherein each successive section is operatively interconnected to the next section by a flexible joint means;

(b) an eccentric, cylindrical collar means having a cylindrical hole passing therethrough wherein the central axis of the cylindrical hole is colinear with and displaced radially to one side relative to the central axis of the eccentric, cylindrical collar means and wherein the outer surface of the eccentric, cylindrical collar means opposite the sidewall engaging means encompasses any structure equivalent to the above that forces the drill bit string to the outside of the curved well bore and the drill bit to the inside of the curved well bore being rotary drilled and then holds each in this respective position throughout the drilling of the curved portion of the well bore.

FIG. 7 illustrates a close-up cross-sectional view of another specific embodiment of a flexible drilling apparatus 50 as it begins to deviate through various strata from a starting original well bore 52. In a manner analogous to the previous embodiment of FIG. 2, the cased well bore 52 was first plugged with packer 54 and the casing above the plug 54 was removed. The resulting cavity was then filled with cement 56 which was allowed to harden before drilling a vertical pilot hole 58. The flexible drilling apparatus 50 attached to the flexible drill string 60 upon placement within pilot hole 58 and commencement of rotary drilling immediately begins to build angle (deviate).

Figure 8:
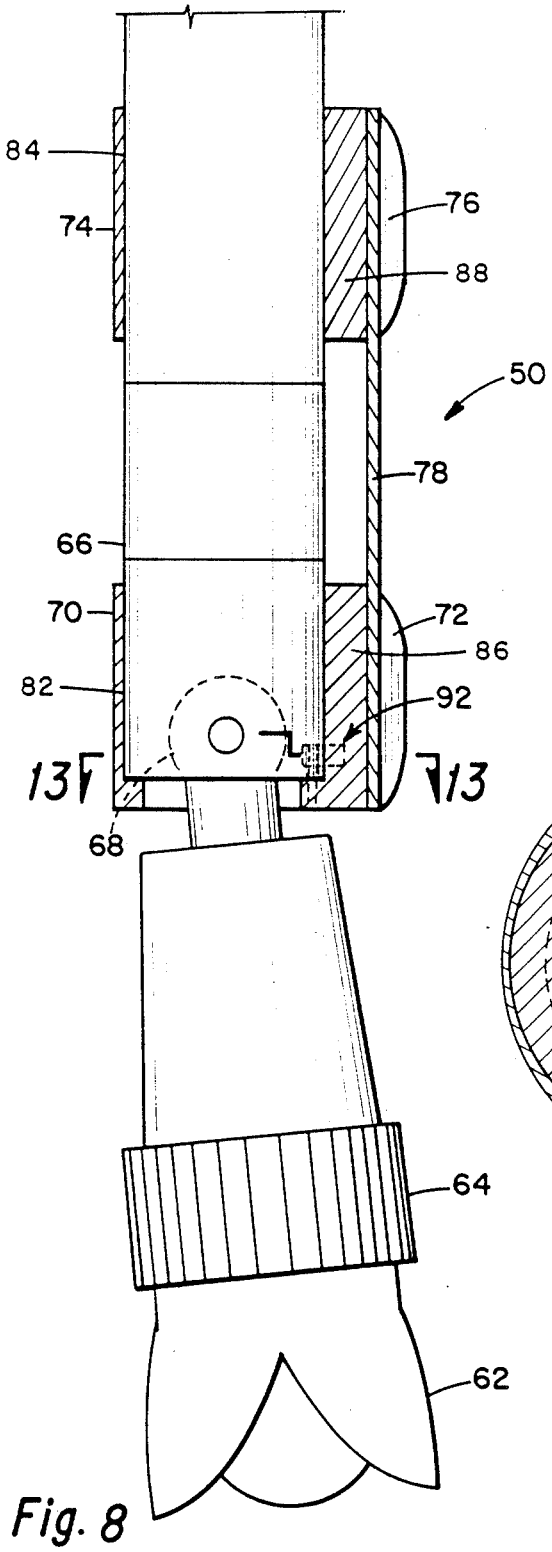
FIG. 8 is a side view of the eccentric drill string collar and eccentric drill string sleeve mounted to a flexible drill string and drill bit shown in FIG. 7.

As illustrated in FIG. 8, the flexible drilling apparatus 50 involves a drill bit 62 and bit collar 64 attached to the end section 66 of flexible string by ball and socket 68. Mounted to the end of section 66 is an eccentric collar 70 with rigid fins 72 similar the previous embodiment of FIG. 2. Further up the end section 66 is a cylindrical, eccentric sleeve member 74 with external fin 76 rigidly attached to eccentric collar 72 by structural member 78.

Figure 10:
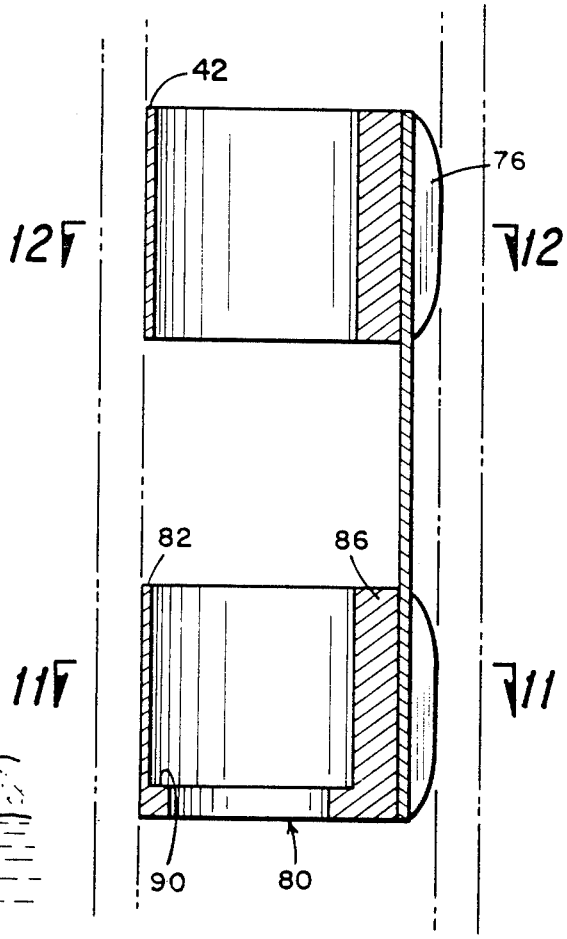
FIG. 10 is a cross-sectional side view of the eccentric drill string collar and attached eccentric drill string sleeve employed in the specific embodiment of FIG. 7 as seen through line 10—10 of FIG. 9.

As seen in FIGS. 8 through 13, the collar 70 and sleeve 74 have a cylindrical hole 80 passing longitudinally therethrough wherein the axis of the hole 80 passing longitudinally therethrough wherein the axis of the hole 80, shown as a dashed line, is intentionally displaced to one side of the central counter axis, shown as a dotted line in FIG. 10, of each creating the desired eccentricity. This again results in an offset with thin regions 82 and 84 and relatively thick regions 86 and 88. The fins 72 and 76 and the structural member 78 are attached to the thicker regions 86 and 88. The plurality of spring steel fins 72 and 76 extend radially outward from the thicker regions and slope in the direction of rotation such as to preload and resist the rotational motion of the flexible drill string revolving within the collar and sleeve. The collar 70 is further equipped with a circular ledge 90 that engages the leading edge of end section 66 during use such as to advance the collar 70 and sleeve 74 as the drill bit advances.

The specific embodiment of FIGS. 7 through 13 is particularly useful in overcoming the inordinate distortions and wear to the flexible steel fins on the eccentric collar during the early stages of drilling. More specifically, the transition from drilling in the initial straight pilot hole to drilling in the curved portion of the deviation involves additional stress and wear as the lead fins of the collar. As such, the trailing sleeve with additional fins ensures alignment of the eccentric collar throughout the drilling of the curved portion of the lateral drainhole.

Figure 14:
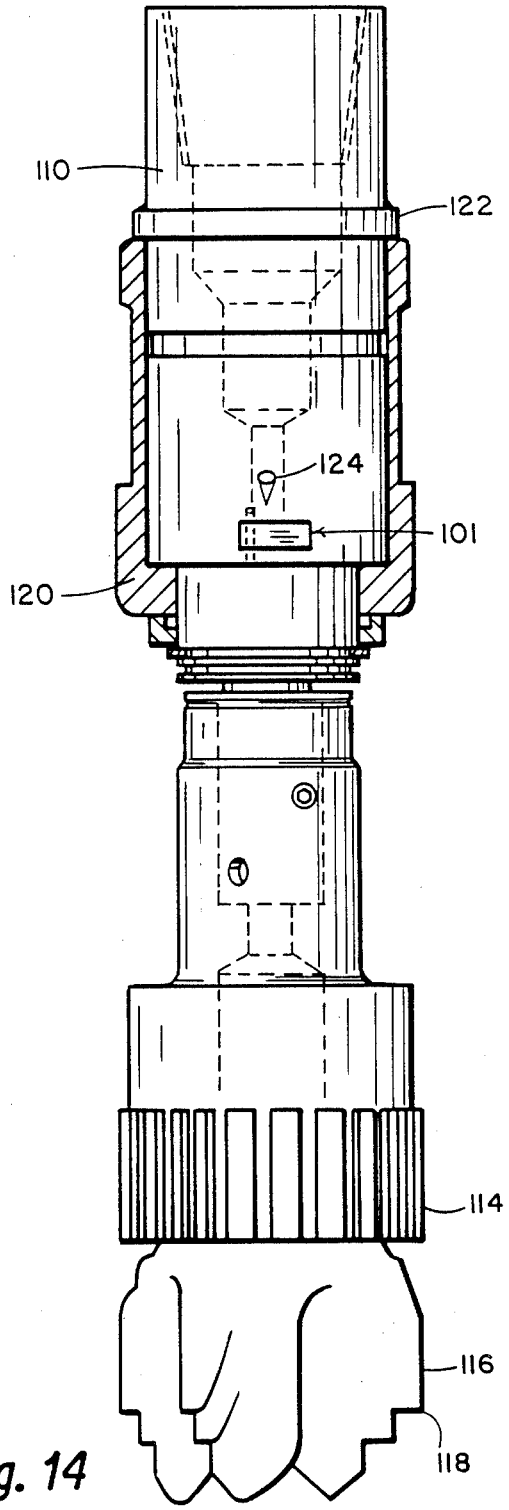
FIG. 14 shows the lower end of my drill string with a drag bit attached thereto.
Figure 17:
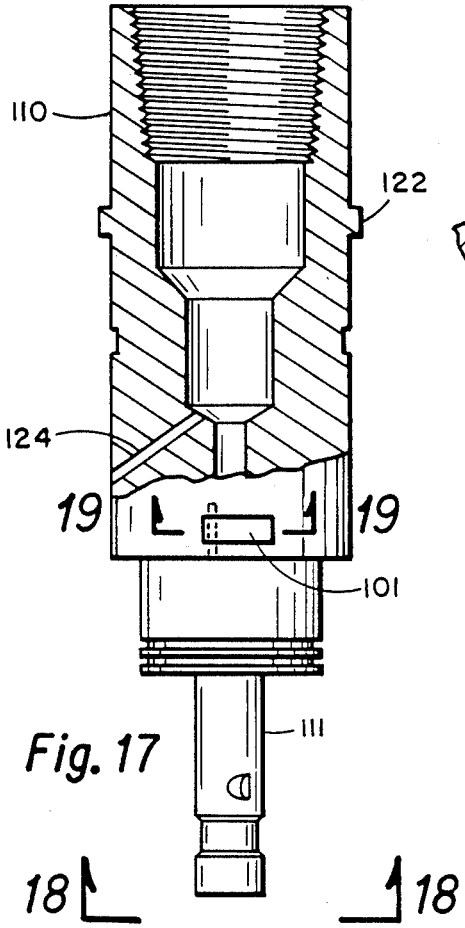
FIG. 17 is a view, partly in cross section, of a lower portion of a drill collar, which is inside the eccentric drill string collar and shows cleaning ports and a deflector ring.
Figure 18:
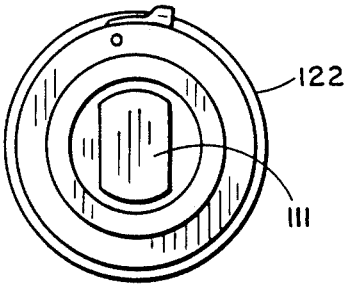
FIG. 18 is a view taken along the line 18—18 of FIG. 17.

Attention is next directed to FIGS. 14, 17 and 18 which show a modification of the eccentric collar in the lower end of the drill string. The lower end of drill pipe 110 is connected by ball joint 112 to the bit assembly which includes a full gauge stabilizer or reamer 114 and a bit 116 which is preferably a drag bit. The drag bit 116 gives improved penetration rate and because it has corner 118 it is especially good for getting started when the deviated lateral hole is first begun. This is especially important if the plug 22. is softer than the formation. Latch 101 between the drill pipe and the collar 120 is shown in detail in FIGS. 19 and 20. An eccentric collar or can 120 fits over the lower end of drill pipe 110 similarly as the eccentric collar 82 fit over the drill pipe 66 in FIG. 8. The lower end of drill string 110 has a deflector ring 122. It is up against the lower edge of this deflector ring 122 that the eccentric collar 120 rests. Sometimes during drilling operations, and especially when first getting started, if the circulation is interrupted, the cuttings being carried by the circulating mud will drop to the bottom of the borehole and a part of those, without deflector ring 122, would enter the annulus or closed space between the eccentric collar 120 the drill pipe 110 and cause severe wearing thereof.

In FIG. 17 a cleansing port 124 is provided from the internal space of the drill string to the space between the drill pipe 110 and the inner wall of the can or eccentric drill collar 120. This is a rather small clearance but it does need to have a cleansing and lubricating fluid provided. This is obtained by the port 124.

Figure 21:
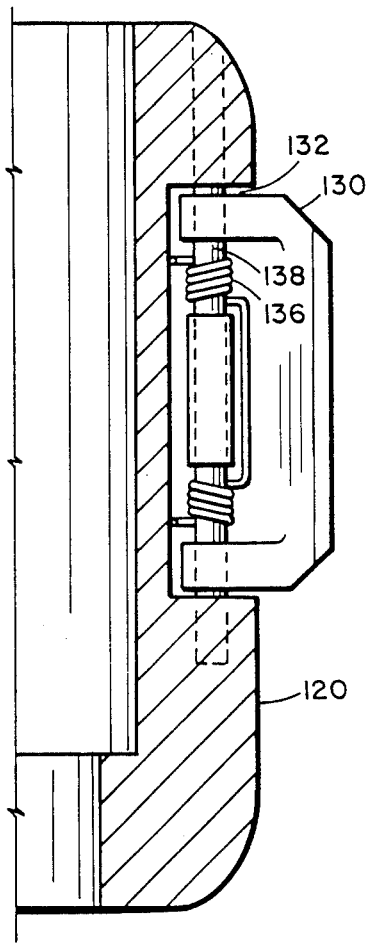
FIG. 21 is a view taken along the line 21—21 of FIG. 16.
Figure 15:
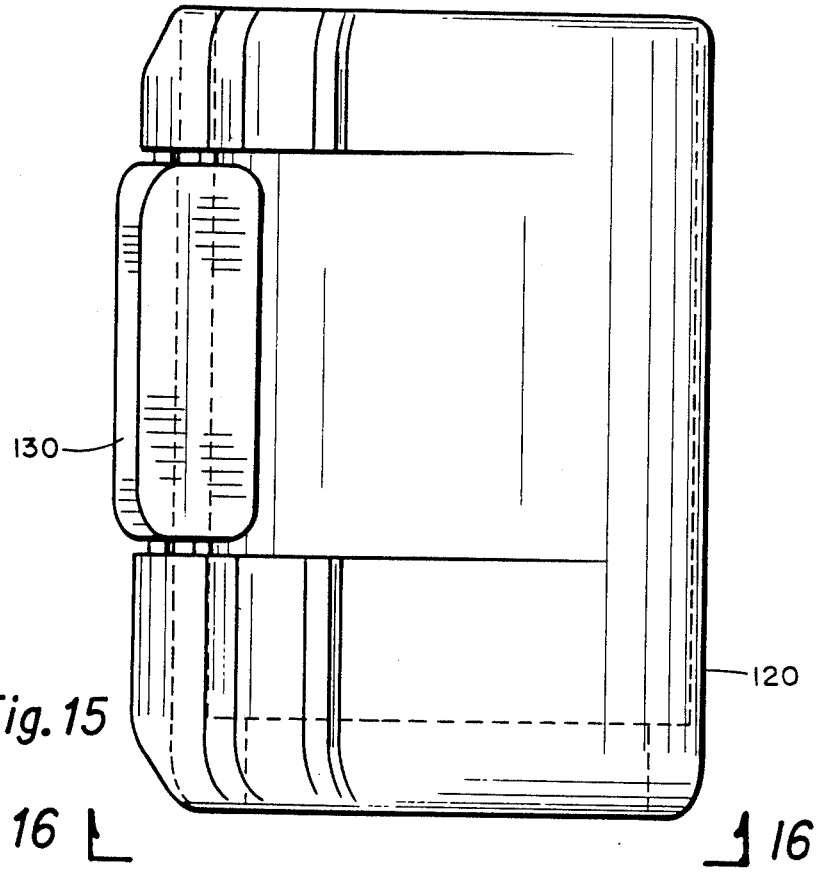
FIG. 15 is a side view of the eccentric drill string collar employed with the specific embodiment illustrated in FIG. 14.
Figure 16:
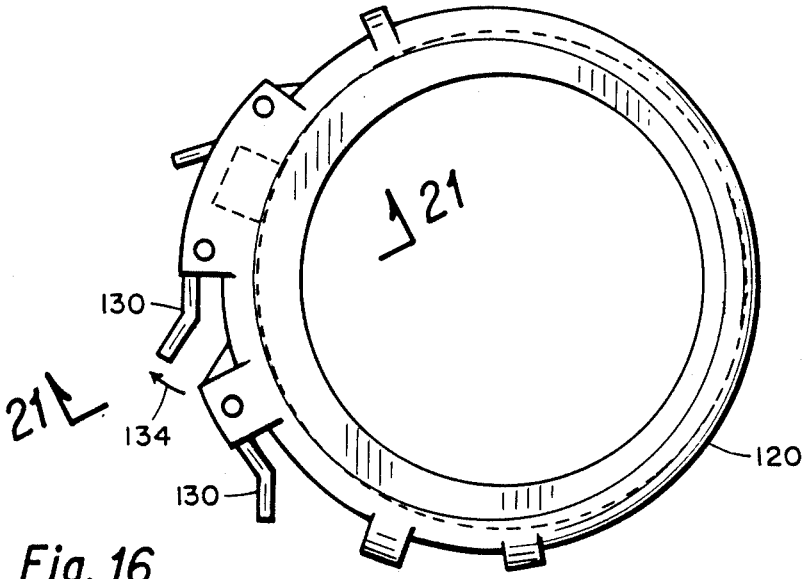
FIG. 16 is a view taken along the line 16—16 of FIG. 15.

Attention is next directed to FIGS. 15, 16 and 21 which show a preferred form of fins. Shown thereon mounted in a cavity 132 in the wall of the eccentric collar 120 are a plurality of fins 130. As shown in FIG. 16, these fins are biased in the direction of arrow 134. They are biased by springs 136 shown in FIG. 21. The fin 130 is mounted on a pin 138 which can be driven through a bore in the top of the eccentric collar 120 as shown by the dotted lines in FIG. 21. Springs 136 cause the fins 130 to be biased and extend outwardly as shown fin FIG. 16 somewhat like a spring on an ordinary clipboard. When drilling is conducted by turning the drill string "to the right" the fins 130 will dig into the sidewall as indicated above in regard to fins 72 in FIG. 8, for example, and they hold the eccentric disc in the proper position. However, when latch 101 is activated to rotate eccentric collar 120 by turning the drill string in the opposite direction, i.e., to the left, the fins 130 will function the same way as fins 72 and permit the turning until the eccentric collar is properly oriented in the same manner as described above in regard to fins 72.

Experience has indicated that other methods of starting the drilling of the curved portion of the lateral drainhole can be employed in the present invention. Thus, the apparatus and method can be used in either an open hole or cased well bore wherein a window is cut in the casing. Further, the process can be initiated from a packer with cement plug as previously illustrated or with the use of a deflector or whipstock or from the bottom of an open hole or the like; however, the use of a whipstock is not necessary. Further, various types of flexible or resilient drilling string sections, flexible joints, reamer or drill bit collars with stabilizers and drill bits can be used all as generally known in the art. The following Table summarizes one set of typical dimensions for a commercial unit as illustrated in FIG. 2. As such, these dimensions should be viewed as being illustrative of one particular preferred embodiment, but not limiting thereto.

TABLE

| | |
|---|---|
| Diameter of drill bit | 3⅞" |
| Diameter of reamer | 3 15/16" |
| Diameter of eccentric collar (fin to opposite side) | 4⅛" |
| Diameter of flexible drill string section | 3.2 |
| Length of flexible drill string section | 12" |
| Length of pivot point on last flexible drill string section to pivot point of ball and socket | 18" |
| Length from pivot point of ball and socket to back edge of reamer | 10" |
| Length of drill bit | 4" |
| Length of eccentric collar (fins) | 5" |
| Furthest point of fulcrum relative to tip of drill bit | 4" |

During field testing of the lateral drilling apparatus similar to that illustrated in FIG. 2 when used without the eccentric collar of the present invention, experience indicates that the desired rate of angle building cannot be maintained. Once the lateral drilling and specifically the rotary bit begins to spiral or process off the desired curved path, no method or correction can be successfully applied and the ultimate loss of the angle building will result.

In order to better understand this phenomena and to confirm the efficacy of the eccentric collar with spring steel blades as illustrated in FIGS. 3 through 6, a series of lateral drilling experiments were performed on the surface using the equipment specifically described in the TABLE. To accomplish this, a large horizontal boring machine was modified and adapted to accept a variety of sandstone and limestone boulders (several ton rocks). The horizontal boring machine was further adapted to continously feed and turn a 25 foot flexible drilling string with ball and socket mounted rotary drilling bit as previously illustrated. A drilling mud circulating system simulating the characteristics of downhole oil and gas well operations was provided. To a great extent the rock was visually exposed such that the start of the lateral drilling process as well as the apparatus could be inspected and monitored throughout the testing.

Various starting techniques were successfully tested including the use of a whipstock and a pilot hole, as well as the cement plug method. In the absence of the eccentric collar with protruding blades to guide the eccentric collar, all curved drilling failed by spiraling. The mode of failure was consistently a matter of the drill bit drifting to the right causing the curved hole to spiral. Modifying the length, position and configuration of the reamer bit (the fulcrum) as well as the use of a "stabilizer rod" inserted centrally within the mud passage of the flexible drill string failed to alleviate or correct the inherent drift to the right. From direct observation of the lateral drilling process without the eccentric collar being present, it was concluded that the stabilizer or reamer adjacent to the drill bit was cutting predominantly on the bottom of the hole and as angle began to build, the flexible knuckle (ball and socket) would climb the left side of the borehole and the drill bit and resulting curved borehole would drift to the right.

Further surface testing of the same equipment in the same sample rocks, but with the eccentric collar and well bore engaging means present to guide or steer the angle building apparatus, confirmed that a perfectly circularly curved section of well bore with an average climb of 4.66 degrees per foot over the length of approximately 5 feet could be repeatedly achieved. Further testing confirmed that it was possible to drill multiple holes from one borehole. The procedure was to put a 3 foot section of drill pipe between the bit and the flexible collars which section had full gaged stabilizers located at several points along its length. The results were that the assembly drilled past the first point of departure making it possible to drill another lateral from the second lower depth.

Figure 13:
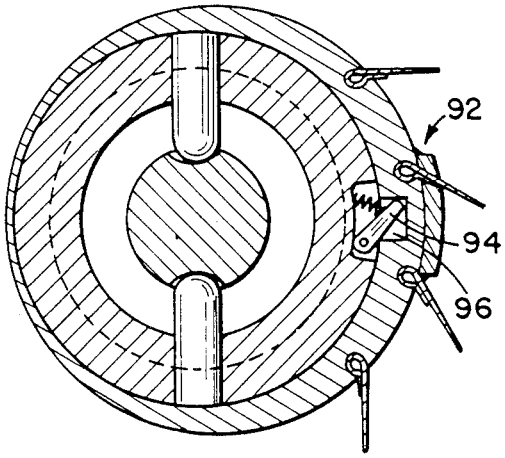
FIG. 13 is a cross-sectional view of the eccentric drill string collar and ratchet mechanism of FIG. 8 as seen through line 13—13.
Figure 11:
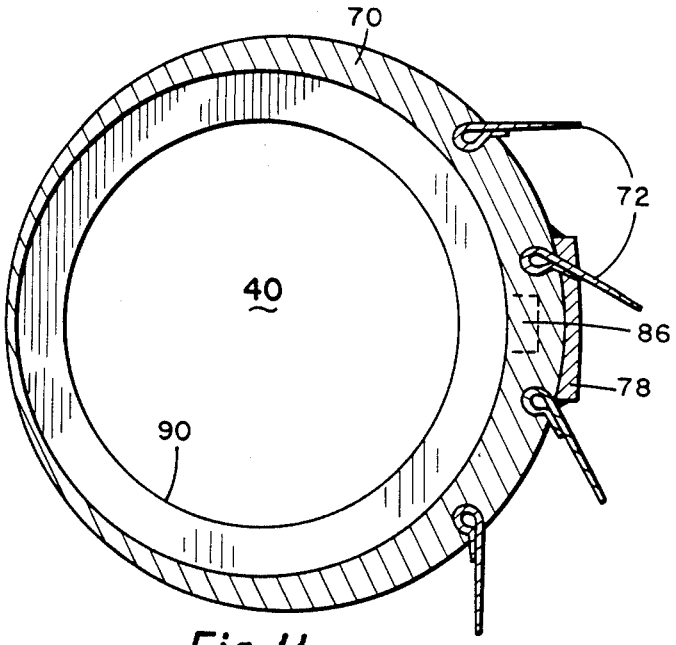
FIG. 11 is a cross-sectional view of the eccentric drill string sleeve as seen through line 11—11 of FIG. 10.
Figure 12:
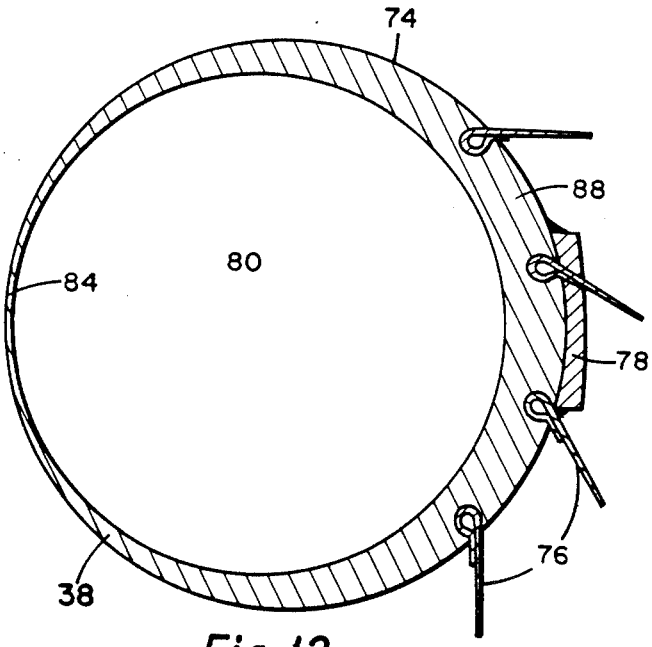
FIG. 12 is a cross-sectional view of the eccentric drill string sleeve as seen through line 12—12 of FIG. 10.

As further illustrated in FIGS. 8 and 13, a latching mechanism 92 is employed. This latching mechanism 92 allows the drill string and specifically the end segment 66, when turned in a direction opposite to the rotation during drilling, to lock itself to the eccentric collar means or guide 70, thus enabling the guide 70 to be oriented from the surface. As illustrated in FIGS. 8 and 13, the lower end of the flexible drill string 66 containing the pinned ball and socket joint 68 is also equipped with a spring biased cog 94. The eccentric collar 70 surrounding the end of the flexible drill string 66 is equipped with an opening or hole 96 which correspond spacially to the relative positions of the cogs 94. As such, the inclined surface on the cog 94 will allow the drill string to rotate freely when drilling. However, when the reverse rotation is applied to the drill string the cog 94 will extend into hole 96 and thus turn the collar 70 and sleeve 76 thus re-orienting the steel fins 72 and 76. In this manner the desired positioning of the eccentric collar guide can be achieved in order to control the direction of the curved drilling.

Figure 19:
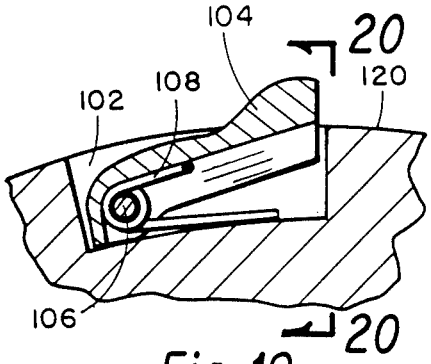
FIG. 19 is a cut-away view taken along the line 19—19 of FIG. 17 partly in section showing the spring loaded fins in the outer wall of the eccentric drill string collar of FIG. 15.
Figure 20:
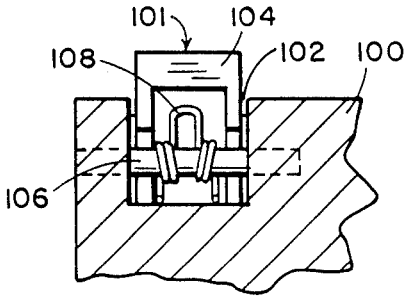
FIG. 20 is a view taken along the line 20—20 of FIG. 19.

An especially preferred latching means is illustrated in FIGS. 19 and 20 which shows a latch 104 which is mounted about pivot pin 106 in cavity 102 of the wall of the eccentric drill string collar 120. A spring 108 such as the spring on an ordinary paper clip board urges the latch 104 out to the position shown in FIG. 19. The latch means of FIGS. 19 and 20 preferably replaces the latching mechanism 92 of FIG. 13.

In testing the above latching mechanisms experience indicates that the relative position of the fins and hence the orientation and direction of curvature of the lateral drilled drain hole can be observed and controlled from the surface. This is achieved by initially starting with the cog engaged in the opening in the eccentric collar guide and recording or marking each drill string segment and pipe joint as the drill string is assembled on the drilling rig. Consequently, the final drill string segment at the drilling rig will be marked such that whenever the direction of rotation is reversed and the cog engages in the opening in the eccentric collar, the mark at the drilling rig will again reflect the true orientation of the fins downhole. The drill string can then be rotated in the reverse direction (cog engaged to opening) which spins the eccentric collar means until the desired direction is again achieved. This process of periodically lifting the drill bit and angle building assembly off the bottom of the hole and reversing the direction of rotation until the desired orientation is again achieved has been found to be particularly useful in preventing the undesirable helical or spiral curvature of the curved drill path. Preferably the reversing of the direction of rotation to reorient the collar should be done every few feet or even more frequently. Experience indicates that repeating the process every six inches of drilling during the drilling of a tight curve will virtually eliminate all tendencies for spiral deviation, resulting in an essentially curved bore hole in a single plane.

The advantages and benefits of the present invention are felt to be numerous and significant. First and foremost, the present invention provides a reliable method of drilling a curved portion of a lateral drainhole without encountering the problem of the directional drift of the drill bit and the resulting helical or spiral pathway of the well bore. As such, the present invention provides a predictable and reproducible method of controlling the final orientation and position of the drainhole. Furthermore, the method is highly versatile in that it can be employed to complete a new well or as a work over procedure of an old well, whether the well is cased or open hole. The system is also amenable to multiple deviations from one borehole or multiple changes in the direction of a single drainhole. In fact, the present invention provides a method of arbitrarily steering the direction of a well bore through multiple bends and curves of any arbitrary radius of curvature, length as well as absolute orientation. The method and apparatus are also viewed as being relatively inexpensive. Traditional expensive equipment such as whipstock is not necessary, nor is the addition of the eccentric collar and eccentric sleeve with well bore engaging means a significant capital expenditure.

Having thus described the invention with a certain degree of particularity, it is manifest that many changes can be made in the details of construction and the arrangement of components without departing from the spirit and scope of this disclosure. Therefore, it is to be understood that the invention is not limited to the embodiment set forth herein for purposes of exemplification, but is to be limited only by the scope of the attached claims, including a full range of equivalents to which each element thereof is entitled.

What is claimed is:

1. A drill apparatus for drilling a lateral curved borehole from a main borehole comprising:

a drill bit stabilizer collar and drill bit;

a flexible drill shaft terminating at the lower end with a flexible connection operatively attaching the flexible drill shaft with said drill bit stabilizer collar;

an eccentric cylindrical collar having a cylindrical hole passing therethrough wherein the central axis of said cylindrical hole is displaced to one side relative to the central axis of the cylindrical collar and wherein the outer surface of said cylindrical collar opposite the side toward which said cylindrical hole is displaced is further equipped with a radially extending borehole engaging means and wherein said cylindrical collar is adapted to mount to the lower end of the flexible drill shaft adjacent to the flexible connection and allow the flexible drill shaft to rotate therein during drilling rotating operations and wherein said radially extending borehole engaging means prevent said cylindrical collar means from rotating during rotary drilling;

a deflector ring attached to the outer surface of the lower end of the flexible drill shaft and adjacent the upper end of said eccentric cylindrical collar.

2. A drilling apparatus as defined in claim 1 wherein that portion of said drill string surrounded by said eccentric collar is provided with at least one port to provide fluid communication from the interior of said drill string to the space between the inner wall of said cylindrical eccentric collar and the outer wall of said portion of said drill string.

3. A drilling apparatus as defined in claim 1 in which said radially extending borehole engaging means includes a pin member, a plate-like pin member mounted on said pin with said pin mounted in a cavity in the wall of said eccentric collar, a spring wound about said pin and biasing said plate-like member in a given direction.

4. A drilling apparatus as defined in claim 1 comprising a ratchet means operatively connected between said eccentric collar and said flexible drill shaft such as to allow the free rotation of said flexible drill shaft with the stationary eccentric collar during drilling and to allow for the positive engagement and subsequent rotation of said eccentric collar when said flexible drill shaft is rotated the opposite direction to that rotated during drilling, said ratchet means including a pin supported in a cavity in the wall of said drill string opening outwardly and a cavity in the inner wall of said eccentric collar, a latch plate mounted around said pin and a spring biasing said latch plate about said pin so that at least a portion of said latch plate extends outside of said cavity.

5. In a drill apparatus for drilling a lateral curved borehole from the main borehole wherein said drilling apparatus comprises a flexible drill shaft terminating at the lower end with the flexible connection oppositely attaching the flexible drill shaft with a drill bit stabilizer collar and drill bit the specific improvement comprising:

an eccentric cylindrical collar having a cylindrical hole passing therethrough wherein the central axis of said cylindrical hole is parallel with and displaced to one side relative to the central axis of the cylindrical collar and wherein the outer surface of said cylindrical collar opposite the side toward which said cylindrical hole is displaced is further equipped with a radially extending borehole engaging means and wherein said cylindrical collar means is further adapted to eccentrically mount to the lower end of the flexible drill shaft adjacent to the flexible connection to allow the flexible drill shaft to rotate therein during rotary drilling and wherein said radially extending borehole engaging means prevent said cylindrical collar from rotating during rotary drilling;

port holes in the wall of the lower end of said flexible drill shaft to provide fluid communication between the interior of the drill shaft and the interior surface of said eccentric cylindrical collar.

6. An improved drilling apparatus of claim 5 including a deflector ring on the outer periphery of the lower portion of said drill shaft to form a cap over the top of the space between said drill shaft and the inner wall of said cylindrical collar.

7. An apparatus as defined in claim 1 in which said drill bit is a drag bit.

8. A drill apparatus for drilling a lateral curved borehole from a main borehole comprising:

a drill bit stabilizer collar and drill bit;

a flexible drill shaft terminating at the lower end with a flexible connection operatively attaching the flexible drill shaft with said drill bit stabilizer collar;

an eccentric cylindrical collar having a cylindrical hole passing therethrough wherein the central axis of said cylindrical hole is displaced to one side relative to the central axis of the cylindrical collar and wherein the outer surface of said cylindrical collar opposite the side toward which said cylindrical hole is displaced is further equipped with a radially extending borehole engaging means and wherein said cylindrical collar is adapted to mount to the lower end of the flexible drill shaft adjacent to the flexible connection and allow the flexible drill shaft to rotate therein during drilling rotating operations and wherein said radially extending borehole engaging means prevent said cylindrical collar means from rotating during rotary drilling;

at least one port means in that portion of said drill string surrounded by said eccentric collar to provide fluid communication from the interior of said drill string to the space between the inner wall of said cylindrical eccentric collar and the outer wall of said portion of said drill string.

9. A drilling apparatus as defined in claim 8 in which said radially extending borehole engaging means includes a pin member, a plate-like pin member mounted on said pin with said pin mounted in a cavity in the wall of said eccentric collar, a spring wound about said pin and biasing said plate-like member in a given direction.

10. A drilling apparatus as defined in claim 8 comprising a ratchet means operatively connected between said eccentric collar and said flexible drill shaft such as to allow the free rotation of said flexible drill shaft with the stationary eccentric collar during drilling and to allow for the positive engagement and subsequent rotation of said eccentric collar when said flexible drill shaft is rotated the opposite direction to that rotated during drilling, said ratchet means including a pin supported in a cavity in the wall of said drill string opening outwardly and a cavity in the inner wall of said eccentric collar, a latch plate mounted around said pin and a spring biasing said latch plate about said pin so that at least a portion of said latch plate extends outside of said cavity.

11. In a drill apparatus for drilling a lateral curved borehole from the main borehole wherein said drilling apparatus comprises a flexible drill shaft terminating at the lower end with the flexible connection oppositely attaching the flexible drill shaft with a drill bit stabilizer collar and drill bit the specific improvement comprising:

an eccentric cylindrical collar having a cylindrical hole passing therethrough wherein the central axis of said cylindrical hole is parallel with and displaced to one side relative to the central axis of the cylindrical collar and wherein the outer surface of said cylindrical collar opposite the side toward which said cylindrical hole is displaced is further equipped with a radially extending borehole engaging means and wherein said cylindrical collar means is further adapted to eccentrically mount to the lower end of the flexible drill shaft adjacent to the flexible connection to allow the flexible drill shaft to rotate therein during rotary drilling and wherein said radially extending borehole engaging means prevent said cylindrical collar from rotating during rotary drilling;

a deflector ring on the outer periphery of the lower portion of said drill shaft to form a cap over the top of the space between said drill shaft and the inner wall of said cylindrical collar.

12. In the drilling apparatus as defined in claim 11 in which said radially extending borehole engaging means includes a pin member, a plate-like member mounted on said pin with said pin mounted in a cavity in the wall of said eccentric collar, a spring wound about said pin and biasing said plate-like member in a given direction.

* * * * *